US005701635A

United States Patent [19]

Hawkes

[11] Patent Number: 5,701,635

[45] Date of Patent: Dec. 30, 1997

[54] DOORKNOB COVER

[76] Inventor: Stanton G. Hawkes, 1750 S. 275 West, #7, Perry, Utah 84302

[21] Appl. No.: 698,545

[22] Filed: Aug. 15, 1996

[51] Int. Cl.[6] ..... E05B 1/00; E05F 5/06

[52] U.S. Cl. ..... 16/114 R; 16/86 A; 16/121

[58] Field of Search ..... 16/114 R, 111 R, 16/116 R, 121, DIG. 12, 86 R, 86 A, 86 B; 294/58; 15/246, 143.1; 81/177.1, 436, 489

[56] References Cited

U.S. PATENT DOCUMENTS

| | | | |
|---|---|---|---|
| D. 329,590 | 9/1992 | Chapman . | |
| 2,131,067 | 9/1938 | Paden | 16/86 A |
| 2,182,611 | 12/1939 | Covert | 16/86 A |
| 2,690,924 | 11/1954 | Johnston . | |
| 2,699,809 | 1/1955 | Nebe et al. | 16/86 A |
| 2,721,597 | 10/1955 | Pitrella | 16/86 A |
| 2,731,056 | 1/1956 | Hanson | 16/86 A |
| 2,753,911 | 7/1956 | Haslett | 16/86 A |
| 3,306,643 | 2/1967 | Reed . | |
| 3,604,741 | 9/1971 | Steere, Jr. . | |
| 5,008,551 | 4/1991 | Randolph | 16/121 |
| 5,011,204 | 4/1991 | Labrum . | |
| 5,050,269 | 9/1991 | Engstrom et al. | 16/118 |
| 5,495,641 | 3/1996 | Going et al. | 16/121 |

*Primary Examiner*—Chuck Mah
*Attorney, Agent, or Firm*—Workman, Nydegger & Seeley

[57] ABSTRACT

A doorknob cover is provided having a receiving chamber configured to removably and snugly receive a doorknob so that rotation of the doorknob cover results in rotation of the doorknob. The doorknob cover further includes an annular sidewall radially extending out from the receiving chamber. The sidewall functions both to assist in rotation of the doorknob and to act as a protective covering from impact against the side of the doorknob. The doorknob cover also includes a bumper pad. The bumper pad extends from one side of the annular sidewall and is made of a soft resiliently deformable material. The bumper pad has a sufficient thickness to prevent damage of a wall or doorknob when the doorknob is impacted against a wall.

12 Claims, 3 Drawing Sheets

DOORKNOB COVER

BACKGROUND OF THE INVENTION

1. The Field Of the Invention

The present invention relates to doorknob covers and, more specifically, doorknob covers that function as doorstops.

2. The Relevant Technology

Doorknobs are used fundamentally as a structure for opening and closing a door. Most often the doorknob is interconnected with a latching mechanism that selectively connects a door to a door frame for keeping a door closed or, if desired, locking a door closed. A typical doorknob comprises a small spherical knob that when rotated, retracts the latching mechanism to allow the door to be freely opened.

Although doorknobs are used extensively in almost all building structures, conventional doorknobs have significant disadvantages. For example, conventional rounded doorknobs can be difficult to rotate particularly for small children, the aged, and those suffering from debilitating conditions such as arthritis.

Furthermore, conventional doorknobs can be a hazard. Doorknobs are typically made of metal and openly extend out from a door. It is thus easy for a doorknob to be swung into a person or for someone to impact against a doorknob. Young children are more susceptible to the dangers of metal doorknobs since doorknobs are mounted close to the height of the head of a child. Furthermore, children are usually more overactive and less careful.

An additional problem with doorknobs is that they are often subject to impacting against an adjacent wall when the door connected thereto is swung open. The result of a doorknob impacting a wall can not only mar the finish on the wall but can also dent or puncture the wall. Furthermore, the impact between a doorknob and a wall can also damage the doorknob.

There are a variety of different doorstops that have been used to prevent doorknobs from directly striking a wall. One of the most common types of doorstop is a tightly-wound spring having opposing ends. One end is typically screwed into the baseboard along the bottom of the wall, adjacent to the door. The other end has a hard rubber cap to provide a cushioning surface for contact with the door that is being swung open. When the spring is attached to the wall, the spring extends perpendicularly away from the wall a distance sufficient to prevent the door and particularly the doorknob from directly contacting the wall.

Spring doorstops, however, have the drawback of making a hole in the baseboard or wall when affixed thereto. As such, renters or others who might be hesitant to make permanent marks to a building will be discouraged from using this device. Furthermore, since the spring doorstops are positioned against the floor they can be obstructive when cleaning or vacuuming the floor. Finally, since this type of doorstop only contacts the base of the door, a door that is swung open with excessive force can still result in the doorknob impacting the adjacent wall.

As an alternative to the spring doorstops, wall mounted doorstops have also been used to prevent wall damage by doorknobs. The wall mounted doorstops typically comprise a hard rubber disk that is mounted on the wall so that the doorknob impacts against the disk when the door is opened. As such, the wall mount absorbs the impact from the doorknob, thereby preventing damage to the wall.

Wall mounted doorstops, however, have the disadvantages in that they can be difficult to attach to a wall.

Furthermore, attaching the wall mount to the wall often requires holes to be directly drilled into the wall. In addition, the wall mounts are typically unsightly since they are mounted in the middle of the wall.

OBJECTS AND BRIEF SUMMARY OF THE INVENTION

It is therefor an object of the present invention to provide apparatus for more easily rotating an existing doorknob.

Another object of the present invention is to provide apparatus for protecting people and particularly small children from the impact of a doorknob.

It is another object of the present invention to provide apparatus for protecting a wall from being impacted with a doorknob.

Yet another object of the present invention is to provide apparatus for protecting a doorknob from being damaged when impacted against a wall.

Another object of the present invention is to provide apparatus to achieve the above objectives without having to replace the doorknob or make permanent marks on the door or wall.

To achieve the foregoing objects, and in accordance with the invention as embodied and broadly described herein, a doorknob cover is provided having an exterior surface and an interior surface. The interior surface defines a receiving chamber having an opening extending through the exterior surface. The receiving chamber is configured to removably receive a doorknob in a sufficiently snug engagement to enable rotation of the doorknob by rotation of the doorknob cover.

Encircling and radially projecting out from the receiving chamber is an annular sidewall. The annular sidewall is preferably made of soft, cushioning material and typically extends greater than about 10 mm from the interior surface of the receiving chamber. The annular sidewall increases the moment arm around the doorknob enabling the doorknob to be more easily rotated. Furthermore, the cushioning aspect of the doorknob cover makes the doorknob more easily grasped and also protects persons from accidental impact therewith.

Finally, the doorknob cover also includes bumper pad which extends from the end of the annular sidewall at a point opposite the opening to the receiving chamber. In this configuration, the bumper pad is positioned between the doorknob and the wall when the doorknob is swung so as to impact against the wall. The bumper pad is also made of a soft, flexible material and has a sufficient thickness so as to protect both the doorknob and the wall as a doorknob is impacted against a wall. The bumper pad also functions to protect individual who may also be accidentally impacted by the doorknob.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
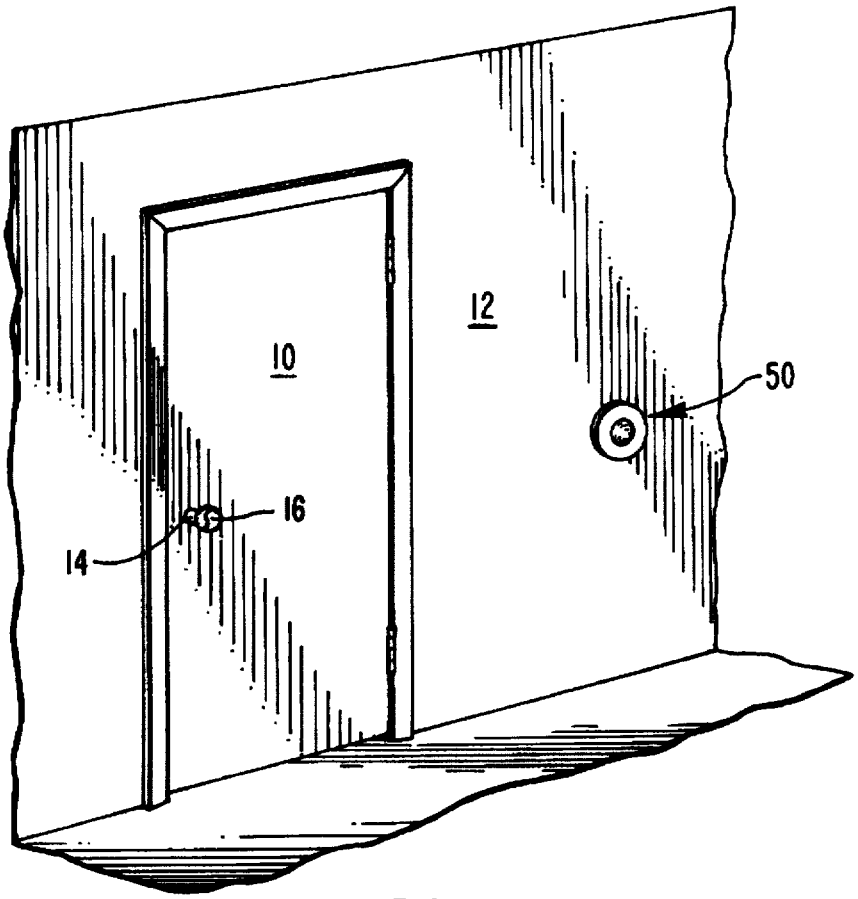
FIG. 1 is a perspective view of an inventive doorknob cover mounted on a doorknob.
Figure 2:
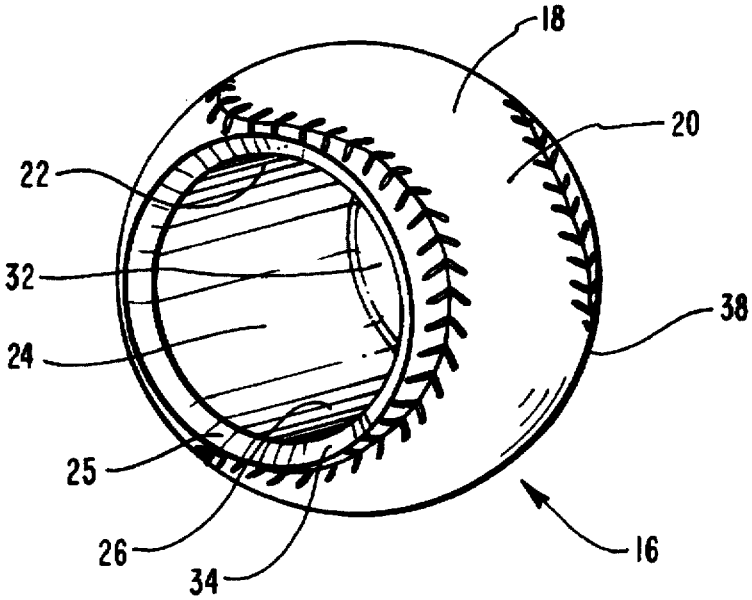
FIG. 2 is an enlarged perspective view of the doorknob cover shown in FIG. 1.

Depicted in FIG. 1 is a door 10 hingedly mounted to a wall 12. Door 10 includes a doorknob 14 being partially received within an inventive doorknob cover 16. Doorknob 14 actuates a latching mechanism (not shown) by annular rotation of doorknob 14. As better depicted in FIGS. 2 and 3, doorknob cover 16 comprises a substantially spherical body 18 having an exterior surface 20 and an interior surface 22.

Interior surface 22 defines a receiving chamber 24 having a circular opening 25 extending through exterior surface 20. More specifically, interior surface 22 comprises a cylindrical inner side surface 26 extending from a first end 28 to a second end 30. Formed at second end 30 is a circular end wall 32. Finally, extending between first end 28 of inner side surface 26 and exterior surface 20 is a sloped shoulder 34. As will be discussed later in greater detail, shoulder 34 assists in receiving doorknob 14 within receiving chamber 24.

Body 18 is also shown as comprising an annular side wall 36 that generally extends between a first end 37 and a second end 39. Body 18 is substantially defined by the area bounded between opening 25 and end wall 32 and between inner side surface 26 and exterior surface 20. Body 18 is also shown as comprising a bumper pad 38 which is substantially defined by the area bounded between end wall 32 and exterior surface 20.

Figure 4:
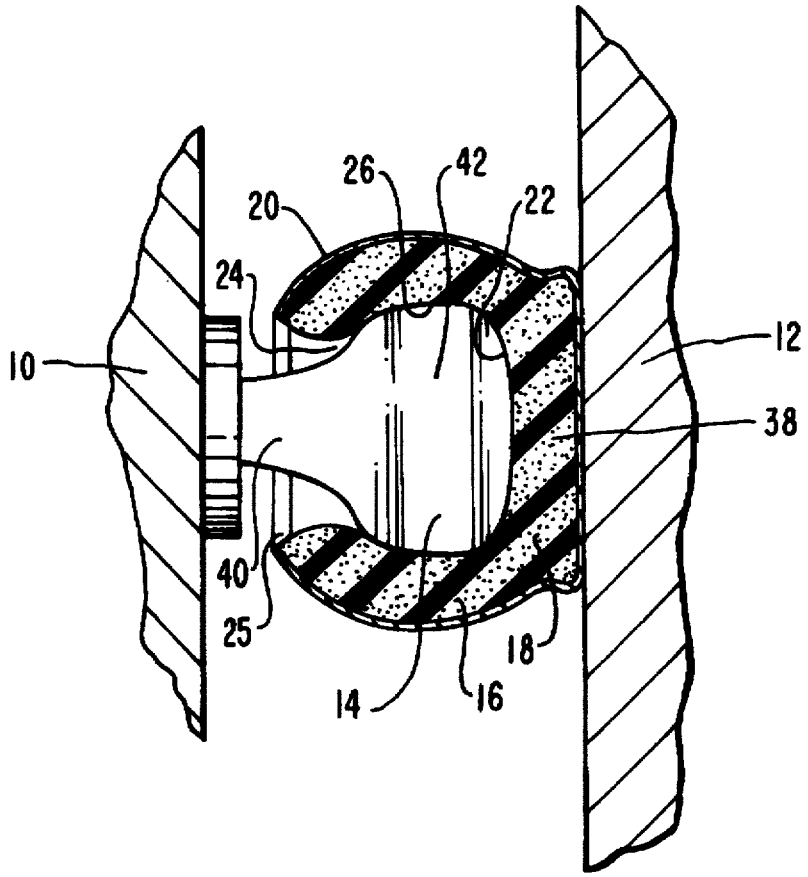
FIG. 4 is a cross-sectional side view of the doorknob received within the doorknob cover shown in FIG. 1 and biased against a wall.

In one embodiment of the present invention, attaching means are formed on body 18 for manually removably attaching body 18 to doorknob 14 so that rotation of body 18 results in rotation of doorknob 14. By way of example and not by limitation, one embodiment of the attaching means comprises receiving chamber 24 which is configured to manually, removably receive doorknob 14 as shown in FIG. 4.

Receiving chamber 24 is configured so that interior side surface 26 snugly biases against doorknob 14. As a result, doorknob cover 16 is snugly secured over doorknob 14 so that rotation of doorknob cover 16 results in rotation of doorknob 14. To ensure that doorknob cover 16 has sufficient frictional engagement against doorknob 14, it is preferred that interior surface 22 be made from an elastomeric material such as a polyurethane foam or some form of rubber.

An additional benefit of making interior surface 22 out of an elastomeric material is to enable a single size receiving chamber 24 to fit a number of different sized doorknobs 14. In an alternative embodiment, doorknob cover 16 can be made having a variety of different sized receiving chamber 24 for fitting different sized doorknobs 14.

Figure 3:
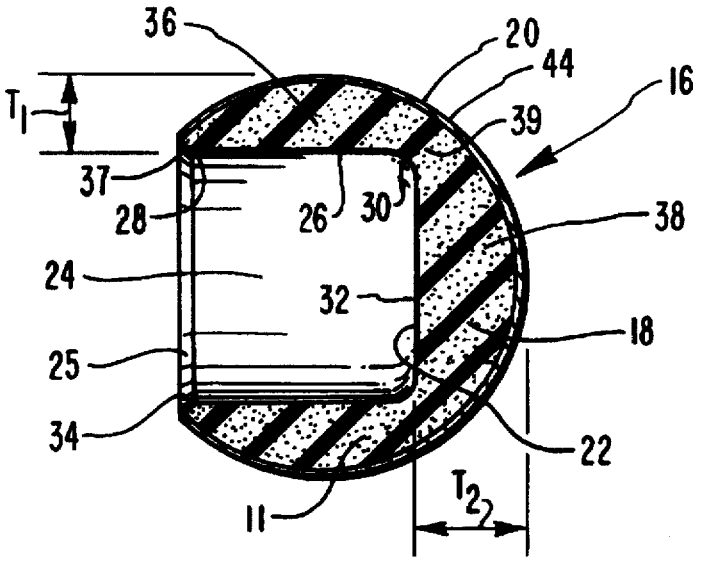
FIG. 3 is a cross-sectional side view of the doorknob cover shown in FIG. 2.

The present invention also includes rotating means for decreasing the force required to rotate doorknob 14 when body 18 is attached to doorknob 14. By way of example and not by limitation, one example of the rotating means as depicted in FIG. 3 comprises annular side wall 36 having a maximum thickness $T_1$ in a range between about 5 mm to about 30 mm with about 10 mm to about 25 mm being more preferred. Thickness $T_1$ of side wall 36 results in an increased moment arm that makes it easier to rotate doorknob 14. Thickness $T_1$, however, should not be so large as to prevent the user from being able to grasp annular side wall 36.

It is also preferred that annular side wall 36 be made of soft resiliently deformable material that makes it easier for a user to grab and hold onto doorknob cover 16. Preferred materials include polyurethane foam and other soft rubber materials. Accordingly, as a result of attaching doorknob cover 16 over doorknob 14, doorknob 14 is much easier to rotate and thus easier to open door 10.

In another embodiment, the present invention also includes cushioning means formed on body 18 for cushioning the impact of doorknob 14 against wall 12 when body 18 is attached to doorknob 14, thereby substantially preventing damage to wall 12 and doorknob 14. By way of example and not by limitation, one example of the cushioning means comprises bumper pad 38 being made of a soft, resiliently deformable material and having a thickness $T_2$. The combination of the type of material and thickness $T_2$ is optimized so that bumper pad 38 substantially absorbs or more uniformly displaces the energy resulting from doorknob 14 impacting against wall 12. This optimization substantially prevents any significant damage to either doorknob 14 or wall 12.

More specifically, as shown in FIG. 4, as door 10 is opened and doorknob cover 16 comes in contact with wall 12, bumper pad 38 begins to compress and absorb much of the energy of moving door 10. Bumper pad 38 brings opened door 10 to rest over a longer period of time than would be the case if the doorknob cover 16 were not present. Additionally, bumper pad 38 transfers the force of moving door 10 to wall 12 over a larger surface area than would be the case if the doorknob cover 16 were not present. Thus, bumper pad 38 provides cushioning means according to the present invention.

In the preferred embodiment, bumper pad 38 is made of a polyurethane foam. Alternatively, bumper pad 38 could also be made of most conventional rubber materials that would perform the desired function. The thickness $T_2$ of bumper pad 38 is typically in a range between about 10 mm to about 40 mm with about 15 mm to about 30 mm being preferred. In an alternative embodiment of the cushioning means, bumper pad 38 could be formed from a variety of alternative energy absorbing configurations, for example, a compressive spring or an inflatable air or fluid bladder.

As depicted in FIG. 4, doorknob 14 comprises a neck 40 and an enlarged head 42 attached thereto. Receiving chamber 24 is preferably designed so that head 42 is enclosed therein. Furthermore, it is preferred that body 18 have a thickness greater than about 5 mm and more preferably greater than 10 mm at all points extending between interior surface 22 and exterior surface 20. The one exception to this is the portion of body 18 adjacent to opening 25 where interior surface 22 and exterior surface 20 intersect. This thickness provides a protective cover around doorknob 14 in case doorknob 14 is struck from around the side or the end thereof.

As also depicted in FIG. 3, in one embodiment of the present invention a surface coating 44 may be optionally positioned over exterior surface 20 of doorknob cover 16. Surface coating 44 comprises a fluorescent or luminescent material to make doorknob cover 16 visible at night or in a darkened room. The fluorescent or luminescent material may be any of a number that are commonly known in the art. Accordingly, by adding surface coating 44, doorknob cover 16 also functions as a night light. It should be noted, however, that surface coating 44 provides advantages for the present invention, but it is not a necessary component thereof.

In view of the above disclosure, a user of the present invention can easily attach doorknob cover 16 to doorknob 14. To do so, a user grasps exterior surface 20 and brings doorknob cover 16 to a position where opening 25 is adjacent to the free end of doorknob 14. At this point, the user firmly pushes doorknob cover 16 so that doorknob 14 is received within receiving chamber 24. In this way, sidewall 36 conforms and snugly fits against doorknob 14. The user continues pushing until it is sensed that the free end of doorknob 14 has contacted end wall 32. The doorknob cover 16 is also easily removed. To do so, a user simply grasps exterior surface 20 and firmly pulls doorknob cover 16 off doorknob 14.

Based on the above disclosure, doorknob cover 16 provides a variety of useful functions. More particularly, doorknob cover 16 makes it easier to both grasp and rotate doorknob 14. Tills function is most applicable to young children, the elderly, and those suffering from debilitating conditions such as arthritis. Doorknob cover 16 also acts as a protective cover for doorknob 14, especially for small children, to prevent injury resulting from doorknob 14 being impacted or impacting a person. Doorknob cover 16 acts as a protective cover not only for the end of doorknob 14 but also for the side thereof.

In addition, doorknob cover 16 acts as a doorstop to prevent doorknob 14 from directly contacting wall 12, thereby preventing damage to either doorknob 14 or wall 12. Additional benefits to doorknob cover 16 is that it can be manually and removably attached to an existing doorknob 14 and it can be attached without having to make permanent marks to either door 10 or wall 12.

In an alternative embodiment, the above discussed doorknob cover 16 can also be used as part of a doorstop system. As depicted in FIG. 1, the doorstop system includes doorknob cover 16 acting in conjunction with a wall mount 50. Wall mount 50 can come in a number of shapes and sizes and is used as a secondary backup for preventing damage to wall 12 and doorknob 14.

Figure 5:
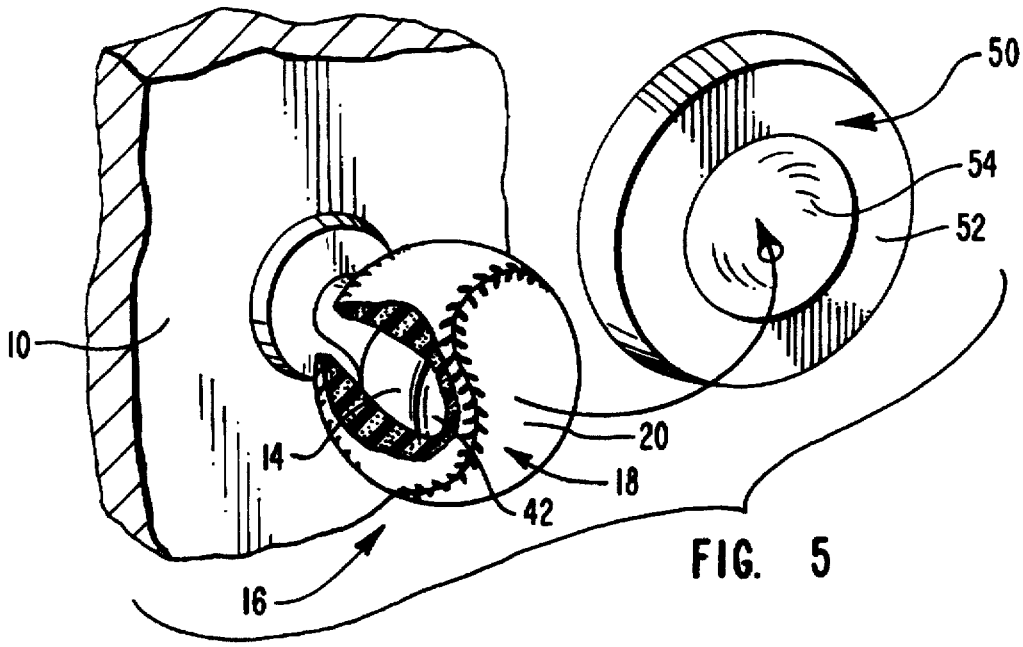
FIG. 5 is a perspective view of a doorstop system including the doorknob cover shown in FIG. 1 and a wall mount.
Figure 6:
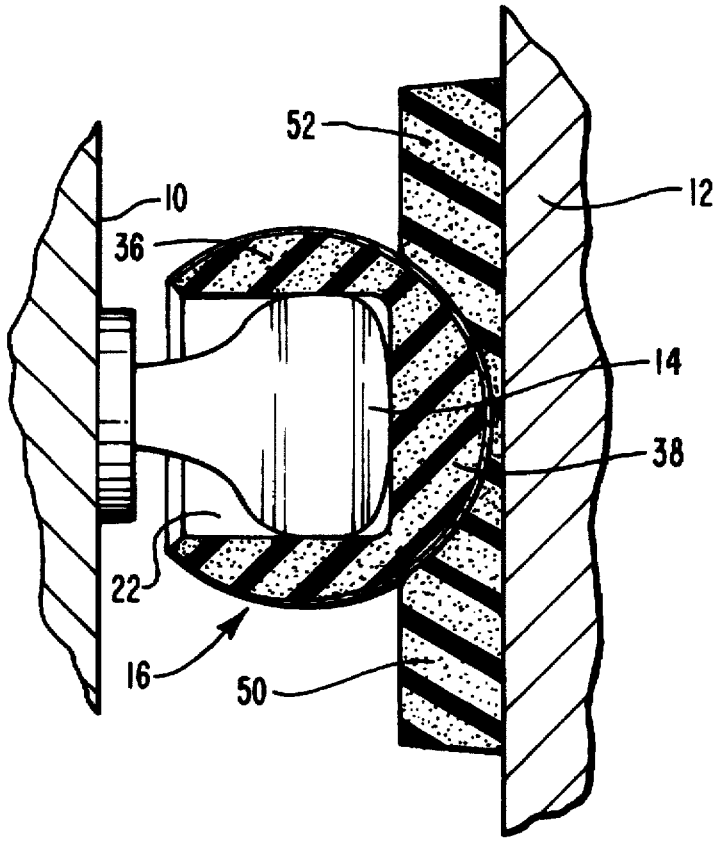
FIG. 6 is a cross-sectional side view of the doorknob cover shown in FIG. 5 being received against the wall mount shown in FIG. 5.

As depicted in FIGS. 5 and 6, wall mount 50 comprises a disk 52 having a recess 54 formed thereon. Recess 54 is shaped to receive doorknob cover 16. Wall mount 50 is preferably made of a soft flexible material such as polyurethane foam and can be attached to wall 12 by conventional methods such as adhesives or screws. Wall mount 50 is selectively mounted to wall 12 so that as door 10 opens, doorknob cover 16 is biased thereagainst.

Doorknob cover 16 can be configured in a number of attractive shapes. For example, it is contemplated that doorknob cover 16 can take the form of a ball used in sports, such as a baseball, soccer ball, tennis ball, or golf ball. Alternatively, doorknob cover 16 may be substantially spherical or cylindrical. As the invention is herein disclosed, it will be apparent that doorknob cover 16 may have any of a number of shapes or may be fashioned to resemble other familiar objects.

Optional wall mount 50 can also have a variety of shapes and dimensions. For example, if doorknob cover 16 is configured to resemble a baseball, wall mount 50 may be configured to resemble a baseball glove. Likewise, if doorknob cover 16 is configured into the shape of a basketball, wall mount 50 may be configured to resemble a backboard. The above descriptions are merely given as examples and are no way limiting.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A doorstop system for use with a doorknob rotatably attached to a door, the door being hingedly mounted to a wall, the doorstop system comprising a doorknob cover having:

(a) an annular side wall having a substantially smooth exterior surface extending from a first end to an opposing second end;

(b) a cylindrical receiving chamber extending through the annular side wall between the first end and the second end thereof at a substantially constant diameter, the receiving chamber being configured to manually and removably receive the doorknob in a sufficiently snug engagement to enable rotation of the doorknob by rotation of the annular sidewall; and (c) a bumper pad mounted to the second end of the annular side wall so as to substantially cover the receiving chamber thereat, the bumper pad being formed of a soft, resiliently deformable material having a thickness sufficient to cushion the impact of the doorknob against the wall when the doorknob is received within the receiving chamber.

2. A doorstop system as defined in claim 1, wherein the annular side wall is formed of a soft, resiliently deformable material.

3. A doorstop system as defined in claim 2, wherein the side wall has a maximum thickness greater than about 10 mm.

4. A doorstop as defined in claim 1, wherein the bumper pad is formed of a urethane foam.

5. A doorstop system as defined in claim 4, wherein the bumper pad has a maximum thickness greater than about 10 mm.

6. A doorstop system as defined in claim 1, wherein the doorknob cover has an exterior surface that is substantially spherical.

7. A doorstop system as defined in claim 1, wherein the doorknob cover is coated with a luminescent material.

8. A doorstop system as defined in claim 1, the doorstop system further comprising a wall mount.

9. A doorstop system for use with a doorknob rotatably attached to a door, the door being hingedly mounted to a wall, the doorstop system comprising a foam rubber doorknob cover including:

(a) a substantially smooth exterior surface having a substantially spherical configuration;

(b) an interior surface defining a receiving chamber, the interior surface comprising a uniform cylindrical inner side surface extending from an opening in the exterior surface to an opposing end wall, the opening and the inner side surface each having a circular transverse cross section of substantially equal diameter, the receiving chamber being configured to snugly receive the doorknob so that rotation of the doorstop results in rotation of the doorknob; and (c) a bumper pad extending from the end wall within the receiving chamber to the exterior surface of the doorstop, the bumper pad being formed of a soft, resiliently deformable material having a thickness sufficient to cushion the impact of the doorknob against the wall when the doorknob is received within the receiving chamber.

10. A doorstop system as recited in claim 9, wherein the doorknob cover is made of urethane foam.

11. A doorstop system as defined in claim 9, the doorstop system further comprising a wall mount.

12. A doorstop system as defined in claim 9, wherein the end wall within the receiving chamber is substantially flat.

* * * * *